US011408268B2

(12) United States Patent
Zalluhoglu et al.

(10) Patent No.: US 11,408,268 B2
(45) Date of Patent: Aug. 9, 2022

(54) AUTONOMOUS DIRECTIONAL DRILLING DIRECTIONAL TENDENCY ESTIMATION

(71) Applicant: HALLIBURTON ENERGY SERVICES, INC., Houston, TX (US)

(72) Inventors: Umut Zalluhoglu, Humble, TX (US); Nazli Demirer, Houston, TX (US); Peter John Hornblower, Cheltenham (GB); Robert Darbe, Tomball, TX (US); Julien Marck, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 456 days.

(21) Appl. No.: 16/523,887

(22) Filed: Jul. 26, 2019

(65) Prior Publication Data

US 2020/0072034 A1 Mar. 5, 2020

Related U.S. Application Data

(60) Provisional application No. 62/725,995, filed on Aug. 31, 2018.

(51) Int. Cl.

| | |
|---|---|
| ***E21B 44/04*** | (2006.01) |
| ***E21B 47/022*** | (2012.01) |
| ***E21B 7/04*** | (2006.01) |
| *E21B 49/00* | (2006.01) |

(52) U.S. Cl.

CPC ..... *E21B 44/04* (2013.01); *E21B 7/04* (2013.01); *E21B 47/022* (2013.01); *E21B 49/00* (2013.01)

(58) Field of Classification Search

CPC . G01V 3/26; G01V 11/00; G01V 3/38; G01V 1/50; G06F 17/18; H04L 67/12; E21B 44/00; E21B 44/04; E21B 47/022; E21B 49/00; E21B 7/04

USPC ..... 166/250.01; 175/24, 39, 45, 61; 324/303, 338, 346; 367/38; 700/108;

(Continued)

(56) References Cited

U.S. PATENT DOCUMENTS 7,085,696 B2 * 8/2006 King ..... E21B 49/003 703/10
8,676,558 B2 * 3/2014 Pirovolou ..... E21B 7/04 703/10

(Continued)

FOREIGN PATENT DOCUMENTS

| | | |
|---|---|---|
| EP | 2531694 B1 | 6/2018 |
| WO | 2018144170 A1 | 8/2018 |
| WO | 2019132929 A1 | 7/2019 |

OTHER PUBLICATIONS

International Search Report. Response & Written Opinion, PCT Application No. PCT/US2019/043799, dated Nov. 11, 2019.

*Primary Examiner* — Jeffrey P Aiello
(74) *Attorney, Agent, or Firm* — Polsinelli PC

(57) ABSTRACT

A method of drilling tendency estimation including receiving, at a processor, one or more directional sensor measurements from a drilling tool disposed on a drill string, processing, at the processor, the one or more directional sensor measurements to determine an actual wellbore trajectory over a defined interval, and identifying, at the processor, a set of directional disturbance parameters by optimization of the actual trajectory of the drilling tool, steering inputs, and/or a set of pre-defined directional disturbance parameters of the drilling tool.

20 Claims, 6 Drawing Sheets

(58) Field of Classification Search
USPC ..... 702/2, 6–9, 13, 141, 150–152, 188–189; 703/2, 7, 10
See application file for complete search history.

(56) References Cited

U.S. PATENT DOCUMENTS

2006/0173625 A1* 8/2006 Moran ..... E21B 44/00 702/9
2007/0185696 A1* 8/2007 Moran ..... G05B 13/027 703/10
2008/0289877 A1* 11/2008 Nikolakis-Mouchas ..... E21B 44/00 175/57
2009/0056935 A1* 3/2009 Prange ..... E21B 43/305 166/245
2010/0185395 A1* 7/2010 Pirovolou ..... E21B 7/04 702/9
2013/0304405 A1* 11/2013 Schmid ..... A61B 5/721 702/56
2015/0369031 A1* 12/2015 Yang ..... E21B 4/02 700/275
2016/0186551 A1* 6/2016 Dykstra ..... E21B 44/00 175/24

* cited by examiner

AUTONOMOUS DIRECTIONAL DRILLING DIRECTIONAL TENDENCY ESTIMATION

CROSS-REFERENCE TO RELATED APPLICATIONS

This application claims the benefit of U.S. Provisional Application No. 62/725,995, filed Aug. 31, 2018, the contents of which are incorporated by reference herein in their entirety.

FIELD

The present technology is directed to a system and method for estimating drilling performance. In particular, the present technology involves a system and method for directional tendency estimation for directional drilling.

BACKGROUND

In an effort to extract hydrocarbons from a subterranean formation, drilling operations are undertaken to form a wellbore through one or more desirable portions of the subterranean formation. Directional drilling operations can be implemented to form the wellbore in the one or more desirable portions of the subterranean formation according to a predetermined well plan. The directional drilling operation can deviate from the desired well plan due to deviations associated with the directional drilling tool including the bit, bottomhole assembly (BHA), and/or subterranean formation features.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
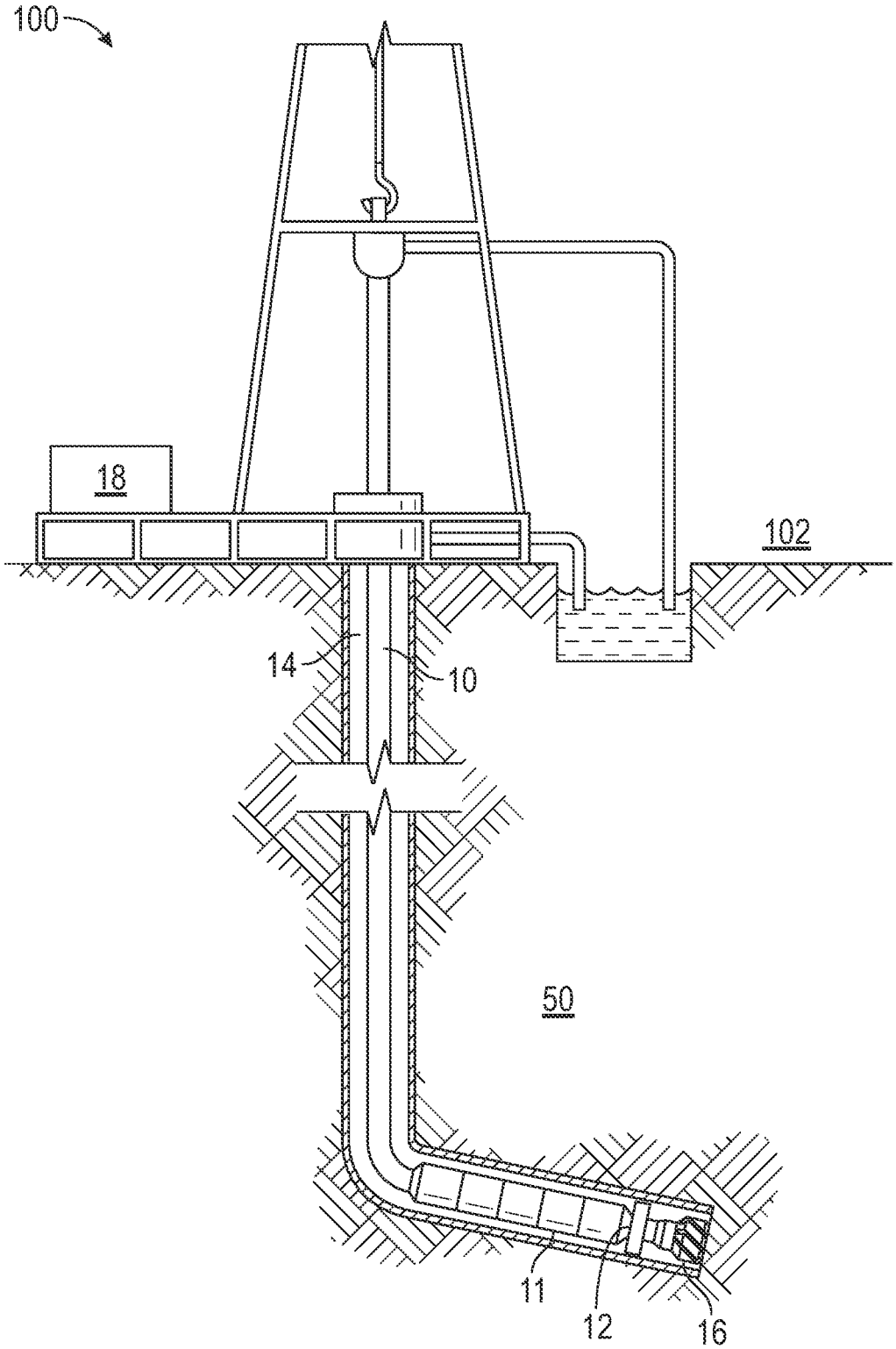
FIG. 1 is a schematic diagram of a directional drilling system with directional tendency estimation according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

The present disclosure is drawn to a system and method for directional tendency estimation for use during directional drilling and/or with directional drilling equipment. The system and method can identify unexpected offsets and/or biases in drilling direction and/or formation-specific trends in curve-generation capabilities of a drilling tool being used to form a wellbore in subterranean formation. The system and method can eliminate and/or reduce the surface interaction with a cruise control system for a rotary steerable system and/or any another direction drilling device. The system and method can adjust, alter, and/or otherwise correct one or more controller settings based on characteristics of the formation (e.g. rock strength, anisotropy, etc.) and the associated discrepancy in the drilling direction and/or error in the curve generation.

The system and method can receive one or more steering inputs (for example, steering ratio and/or tool face) and/or directional sensor measurements (for example, inclination and azimuth) from a selected drilling tool and/or surface measurement. The system and method can use an optimization method to characterize the directional-drilling disturbance effects (for example, drilling direction discrepancy and formation-specific curvature-generation capability of the drilling tool) during the drilling process. The optimization method can be implemented to identify changes of the directional disturbance and/or characterize the disturbances as a function of depth and/or formation. The results can be fed to a downhole (e.g. cruise) control system for direction and/or gain scheduling of the controller parameters, and/or they can be fed to a statistical model on the surface to make more informed steering decisions and/or identity changes in downhole conditions.

The present disclosure can be implemented with mud motors, rotary steerable systems, any drilling tool, and/or components with some actuation mechanism in both onshore and/or off-shore drilling applications. The system and method can further be implemented on the surface or in a drilling tool downhole. While the system and method of the present disclosure is shown and described with respect to a land-based (on-shore) environment and/or method, it is within the scope of this disclosure to implement the system and/or method in a sea based (offshore) environment.

Drilling tools and/or cruise control systems for rotary steerable systems implemented during a directional drilling operation can have one or more predefined directional disturbance parameters that are identified in real time including, but not limited to, tool face offset (and/or bias) and formation-specific curve generation capability (e.g. weight on bit (WOB) dependence, revolution per minute (RPM) dependence). The predefined directional disturbance parameters can be features and/or limitations of the selected (implemented) drilling tools and/or cruise control systems implemented for use within a particular directional drilling operation. The predefined directional disturbance parameters can also include performance and/or limitation features of particular equipment in particular environments (for example, rock formations).

The system and method of the present disclosure can identify the predefined directional disturbance parameters in real time, using the real-time directional sensor measurements; and utilize the identified directional disturbance parameters to adjust and/or alter drilling direction to maintain the directional drilling operation according to the desired well plan.

The system and method of the present disclosure can be implemented to feed adjusted drilling control parameters to the drilling tools and thereby maintain the desired well plan and/or generate a statistical model of the associated directional disturbance control parameters to characterize the disturbance characteristics of the formation.

FIG. 1 illustrates an optimization-while-drilling (OWD) process according to the present disclosure. A drilling process 100 can include one or more drilling tools 11 and related equipment disposed on a surface 102 (or a boat/platform in off-shore based-operations). One or more drilling tools 11 can be coupled with the distal end 12 of a drill string 10. A drill bit 16 can be disposed at the distal end 12 of the drill string 10 and operable to form a wellbore 14 in a subterranean formation 50. The wellbore 14 can be formed according to a desired well plan having one or more vertical, curved, and/or horizontal portions extending through one or more subterranean formations 50. The desired well plan can be operable to place the wellbore 14 through one or more pay zones (or other desirable portions of the) within the subterranean formation 50. The one or more pay zones can be identified portions of the subterranean formation 50 having the most desirable hydrocarbon production potential, and/or highest potential return on investment (ROI) for hydrocarbon production.

The drilling process 100 can be operable to control and/or adjust drilling performance during drilling processes in view of the desired well plan. Further, the drilling process 100 can be operable to generate a statistical model to characterize the disturbance characteristics of the formation. The statistical model generated by the drilling process 100 can assist with determining pre-defined directional disturbance parameters for any subsequent wellbores to be drilling within the same subterranean formation 50 using substantially similar drilling tools 11.

The drilling process can be operable to control and/or adjust drilling performance during drilling processes locally and/or through the surface and/or a remotely located drilling tendency identification system 18. The drill string 10 and/or related drilling tendency identification system 18 can be operable to control the drilling tools 11 locally on the drill string 10 by one or more drilling tools 11, the surface 102, and/or remotely to adjust one or more drilling parameters including, but not limited to, control parameters. While FIG. 1 shows the drilling tendency identification system 18 disposed at the surface 102, it is within the scope of this disclosure to implement the drilling tendency identification system 18 downhole locally on the drill string 10 and/or remotely off-site. In at least one instance, the drill tendency identification system 18 can include, but not limited to, one or more processors, random access memory (RAM), and/or storage medium. It will be appreciated that non-transitory tangible computer-readable storage media storing computer-executable instructions for implementing the presently disclosed technology on a computing system may be utilized. One or more control parameters of the drill string 10 (or other drilling tools and/or components 11) can be adjusted during drilling operations to improve one or more drilling performance measures.

Figure 2:
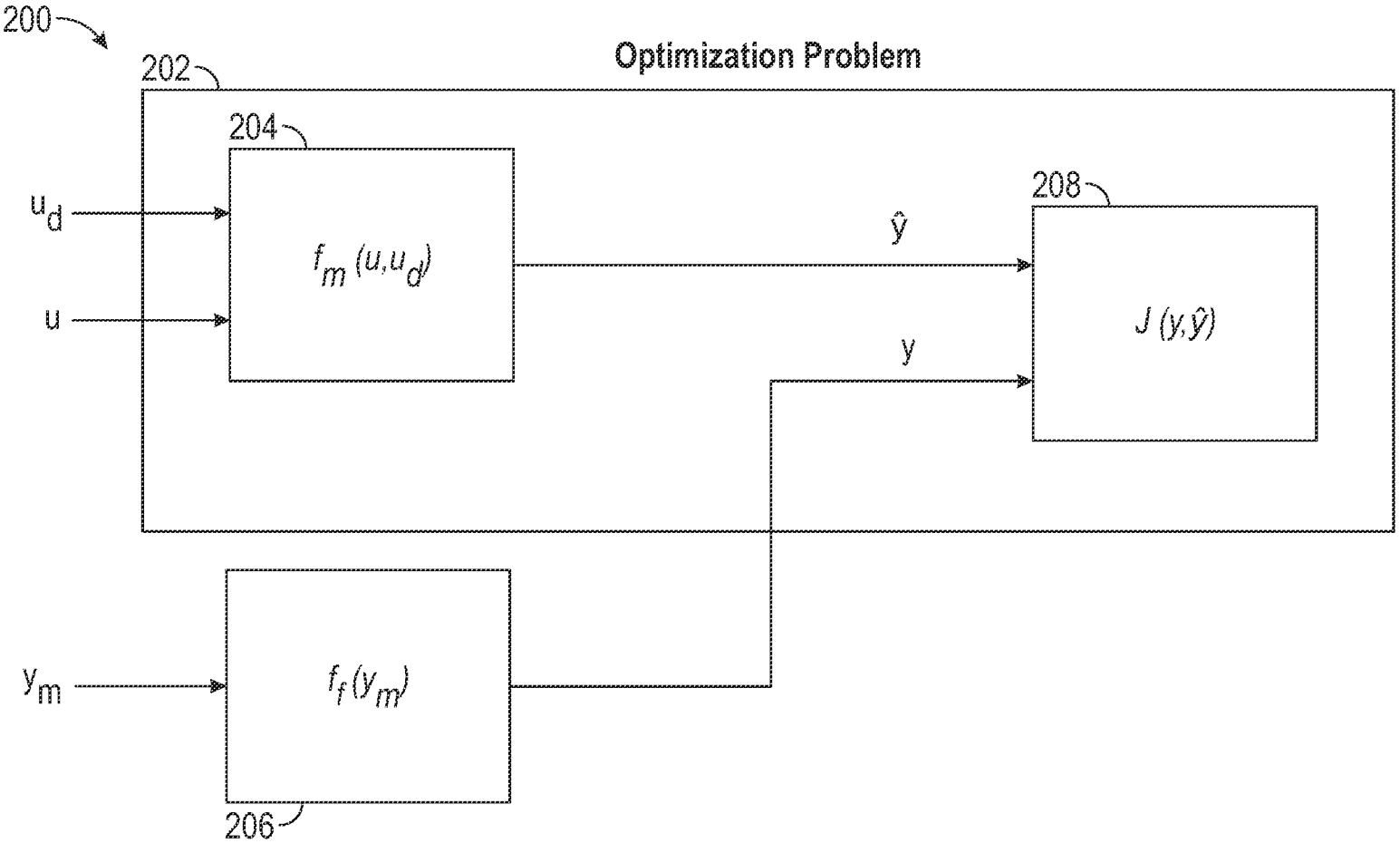
FIG. 2 is a diagrammatic view of a drilling system with directional tendency estimation according the present disclosure.

FIG. 2 is a diagrammatic view representing a directional drilling disturbance characterization process. The directional drilling tendency system 200 can be operable to characterize the disturbances encountered during a drilling operation. The drilling tendency system 200 can include an optimization system 202. The optimization system 202 can include a trajectory model 204 based on one or more received steering inputs (for example tool face and/or steering ratio (for example, bit deflection setting and/or duty cycle)) and/or one or more pre-defined directional disturbance parameters (for example, tool face offset (or bias) and/or curve generation capability). The trajectory model 204 can be represented with a function (formulation), $f_m(u,u_d)$, which can be a function of a steering input vector $u=[\phi,\Sigma]^T$ (toolface, $\phi$, and steering ratio, $\Sigma$), and the directional disturbance parameter set $u_d=[K_d, \phi_d]^T$. $K_d$ and $\phi_d$ represent the formation specific curve-generation capability and/or the discrepancy in drilling direction (for example, tool face offset/bias). These can be tool specific depending on the particular drilling system implement and/or any other known discrepancy, errors, or the like associated therewith.

The trajectory model 204 can output a trajectory vector, $\hat{y}$, which can include curvature, altitude, and/or position. The trajectory model 204 can output an hypothetical trajectory of the directional drilling operation based on the input parameters of the selected drilling tools and/or the formation.

One trajectory model 204 can be a function of the measured depth, $\xi$, shown below:

$$\frac{d}{d\xi}\begin{bmatrix}\hat{k}_\Theta(\xi)\\ \hat{\Theta}(\xi)\\ \hat{k}_\Phi(\xi)\\ \hat{\Phi}(\xi)\end{bmatrix}=\begin{bmatrix}-\frac{1}{\tau_\Theta} & 0 & 0 & 0\\ 1 & 0 & 0 & 0\\ 0 & 0 & -\frac{1}{\tau_\Phi} & 0\\ 0 & 0 & 1 & 0\end{bmatrix}\begin{bmatrix}\hat{k}_\Theta(\xi)\\ \hat{\Theta}(\xi)\\ \hat{k}_\Phi(\xi)\\ \hat{\Phi}(\xi)\end{bmatrix}+\begin{bmatrix}\frac{K_d\sum(\xi)\cos(\phi(\xi)+\phi_d)}{\tau_\Theta}+\frac{\overline{K}_\Theta}{\tau_\Theta}\\ 0\\ \frac{K_d\sum(\xi)\sin(\phi(\xi)+\phi_d)}{\tau_\Phi\sin(\hat{\Theta}(\xi))}+\frac{\overline{K}_\Phi}{\tau_\Phi\sin(\hat{\Theta}(\xi))}\\ 0\end{bmatrix} \quad (1)$$

In the dynamic expression above, $\hat{k}_\Theta$, $\hat{\Theta}$, $\hat{k}_\Phi$, and $\hat{\Phi}$ represent the change in inclination, inclination, change in azimuth and azimuth, respectively. $\tau$ and $\tau_\Phi$ stand for the depth constant (describing how quickly the borehole propagation dynamics respond to the steering inputs and disturbances). $\overline{K}_\Theta$ and $\overline{K}_\Phi$ represent the bias terms that contribute to the change in inclination and curvature (for example, gravity).

The trajectory model 204 can also be described by curvature responding instantaneously to the steering inputs and/or disturbances, shown below:

$$\begin{bmatrix}\hat{k}_\Theta(\xi)\\ \hat{k}_\Phi(\xi)\end{bmatrix}=\begin{bmatrix}K_d\sum(\xi)\cos(\phi(\xi)+\phi_d)\\ K_d\sum(\xi)\sin(\phi(\xi)+\phi_d)/\sin(\hat{\Theta}(\xi))\end{bmatrix} \quad (2)$$

-continued $$\frac{d}{d\xi}\begin{bmatrix}\hat{\Theta}(\xi)\\ \hat{\Phi}(\xi)\end{bmatrix}=\begin{bmatrix}1 & 0\\ 0 & 1\end{bmatrix}\begin{bmatrix}\hat{\kappa}_{\Theta}(\xi)\\ \hat{\kappa}_{\Phi}(\xi)\end{bmatrix}$$

The position of the borehole in a system of reference (for example, in the vertical and/or lateral positions) can also be added as states to the trajectory model. The relationship between attitude (inclination and azimuth) and change of attitude (curvature) shown above, relative to borehole position, can be defined as a function of the change of attitude and curvature. While described with respect to equations (1) and (2) above, the present disclosure is not limited in any way by the illustrative model borehole propagations of equations (1) and (2).

The curvature can also be used exclusively to describe the dynamics in a simpler manner (for example, only the first row shown in equation (2) above). Similarly, only attitude can also be used exclusively as the sole parameters of the propagation model.

The formation-specific curve-generation capability of the drilling tool can also be defined as a base value and a formation dependent perturbation around it: $K=K_{base}+K_d \cdot K_{base}$ would describe the best estimation of the drilling tool's formation independent curvature generation capability. $K_d$ can describe the perturbation around the base value caused by formation effects (for example, rock strength, anisotropy), bit wear, and/or changes in RSS actuation (flow-rate-induced average pad force), etc. In at least one instance, the $K_{base}+K_d$ can replace $K_d$ in equations (1) and (2), or any model used to estimate the trajectory.

The directional drilling tendency system 200 can include a trajectory function 206, $f_f(y_m)$, that can calculate a curvature, attitude, and/or position along an interval (time and/or depth) based on one or more survey measurements, $y_m$. The survey measurements, $y_m$, can include inclination and/or azimuth measurements from stationary and/or continuous surveys. Stationary surveys can be taken during pauses during drilling operations while continuous surveys can be taken during continuous drilling operations. The trajectory function 206, $f_f(y_m)$, can determine the calculated actual trajectory, y, which can include curvature, attitude, and/or positon.

One or more methods, or a combination thereof, can be implemented for the trajectory function 206 including, but not limited to, Finite Impulse Response (FIR) filter, Infinite Impulse Response (IIR) filter, a Gaussian Process Regression (GPR) model, and/or any geometrical trajectory calculation method (for example, minimum curvature method, balanced tangential method, etc.).

For limited computational capacity, the attitude measurements can be passed as trajectory: $y=y_m$.

The outputs of trajectory model 204 and the trajectory function 206 can be inputs to a cost function 208, $J(y,\hat{y})$. The cost function 208 can be minimized within the constrained drilling tendency system 200 and optimization problem below. The cost function can be selected as the error between estimated trajectory, $\hat{y}$, which is output of the trajectory model 204 and the actual trajectory, y, which is output of the trajectory function 206.

$$\min_{u_d} J(y(\xi), \hat{y}(\xi, u(\xi), u_d)) \tag{3}$$

-continued $$\text{subject to } \frac{d}{d\xi}\hat{y}(\xi) = f_m(\hat{y}(\xi), u(\xi), u_d)$$

$$g_i(\hat{y}(\xi)) \le c_i$$

$$i = 1, \ldots, n$$

$$h_j(u_d) \le d_j$$

$$j = 1, \ldots, m$$

$$\xi \in [MD_{start}, MD_{final}]$$

The formulation can be described in depth domain ($\xi$) where the interval can be defined with a starting and ending measured depth (MD). The formulation can also be described in a time domain (t) where the rate of penetration (ROP) can be used to relate the time domain to depth. In above equation (3), $g_i$ can be a function of the estimated trajectory, $\hat{y}$, the inequality represents the inequality constraints on the variables defining the estimated trajectory. These constraints can be utilized to put upper and/or lower bounds on the functions of attitude, curvature, and/or position and/or implemented as equality constraints. Term $h_j$ can be a function of directional disturbance parameters, $u_d$, the inequality can represent the constraints on the directional disturbance parameters. These constraints can similarly be used to put bounds (upper and/or lower) on these parameters.

The cost function 208 and minimization thereof can be done using an optimization solver. If the cost function 208 is selected as the error between the estimated trajectory, $\hat{y}$, and the actual trajectory, y, another option can be to sweep the directional disturbance parameters, $u_d$, within reasonable bounds and calculate the error using a regression method such as the Root-Mean Square Error (RMSE) or least squares method.

Figure 3:
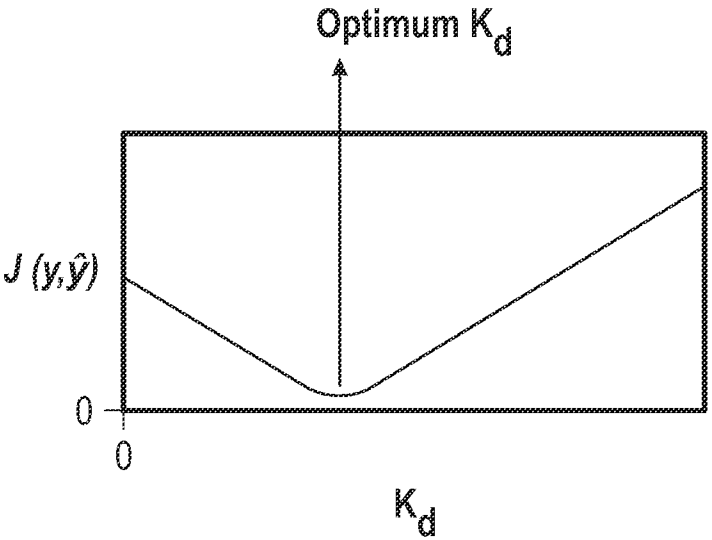
FIG. 3 is a model and result a drilling system with directional tendency estimation according to the present disclosure.
Figure 3:
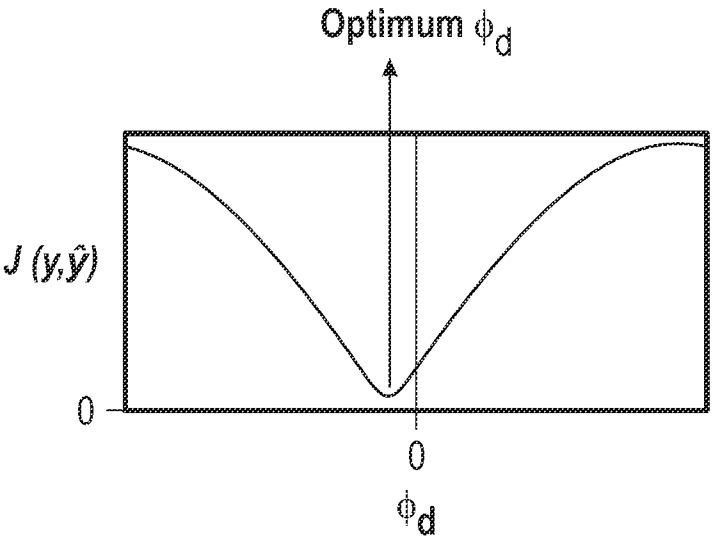

FIG. 3 illustrates identification of the directional discrepancy, $\phi_d$, and the curve-generation ability, $K_d$, of the drilling tool along a time/depth interval within a certain subterranean formation. The optimization procedure shown in FIG. 3 can illustrate a simple cost function selected as the error between the two trajectories, $J(y, \hat{y})=\|y-\hat{y}\|$. The cost function can be selected as any function defining a distance between vectors y and $\hat{y}$ or a combination thereof. The resulting directional disturbance parameters $u_d=[K_d, \phi_d]^T$ can be computed, which minimizes the cost function, as shown in FIG. 3.

In at least one instance, the identified directional disturbance parameter set can be fed to a downhole controller embedded on a drilling tool and/or at any location on the bottomhole assembly (BHA). The controller can be operable to hold the desired wellbore curvature, attitude and/or vertical depth at a set value. The controller can also be operable to reach to the desired wellbore curvature, attitude and/or vertical depth.

In other instances, the identified directional disturbance parameter set can be fed to a statistical model. The statistical model can be generated based on the identified directional disturbance parameters and/or the identified directional disturbance parameters can augment an existing statistical model. The maximum likelihood estimation (MLE) method can be implemented to estimate the statistical parameters (for example, mean, variance, etc.) associated with the selected distribution function (for example, Gaussian, Binomial, Bernoulli, etc.). This information can be implemented by a surface steering control system and/or surface steering advisory system to assist steering decision making. The statistical model generation can be applicable for a particular oil field and/or portion of subterranean formation, thus assisting decision making and directional drilling in all subsequent wellbores drilled into the formation.

Figure 4:
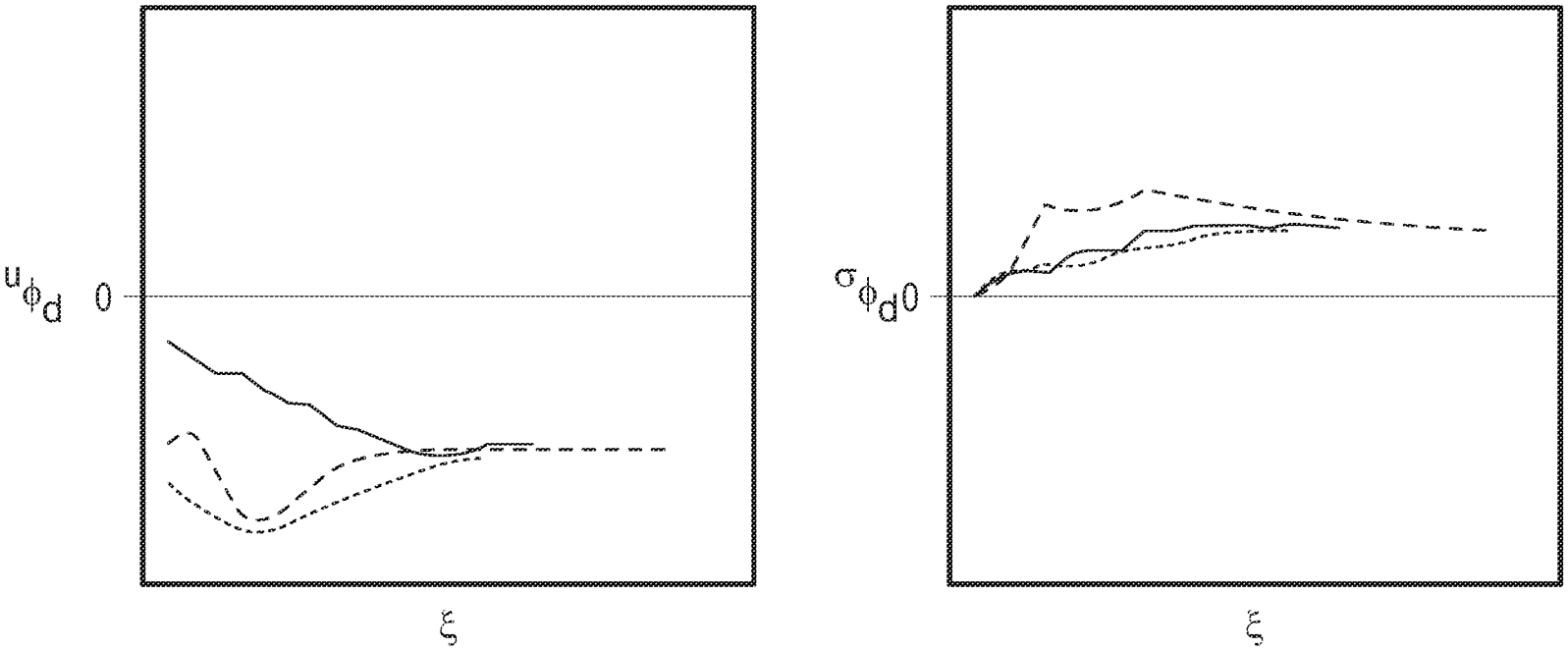
FIG. 4 is a diagrammatic representation of mean and standard deviation as a function of measured depth of three independent tests according to the present disclosure.

FIG. 4 illustrates the evolution of mean and standard deviation of the directional discrepancy, $\phi_d$, for three separate tests as a function of measured depth. FIG. 4 illustrates an example displaying statistical model parameters (mean, $u_d$, and standard deviation, $\sigma_{\phi_d}$) identified separately for three different field tests conducted with the same drilling tool in the same formation. MLE method is used to fit a Gaussian distribution to the collected directional discrepancy, $\phi_d$, data in real time as the drilling took place. The mean and the standard deviation for all three runs converge toward similar values as data is collected through the tests (for example, as depth $\xi$, increases). Therefore, the statistical direction disturbance model generated in one field drilling operation can be used in other drilling operations in the same formation.

The disturbance characterization obtained using the data from similar wells drilled in the same formation can be used to generate a stochastic model to identify directional steering probabilities given position, attitude, and/or steering commands.

Further, in the event the subterranean formation changes during drilling causing collection of outliers to the statistical model on a consistent basis, the process can help indirectly recognize a formation change as well. This can be confirmed by comparing with other measurements (for example, MSE, gamma, etc.) that change based on formation.

The directional disturbance characterizations can be transferrable within a geographical area allowing the values to be used to select and/or optimize the BHA design, bit, well plan, job plan, etc. during the job design phase.

Figure 5:
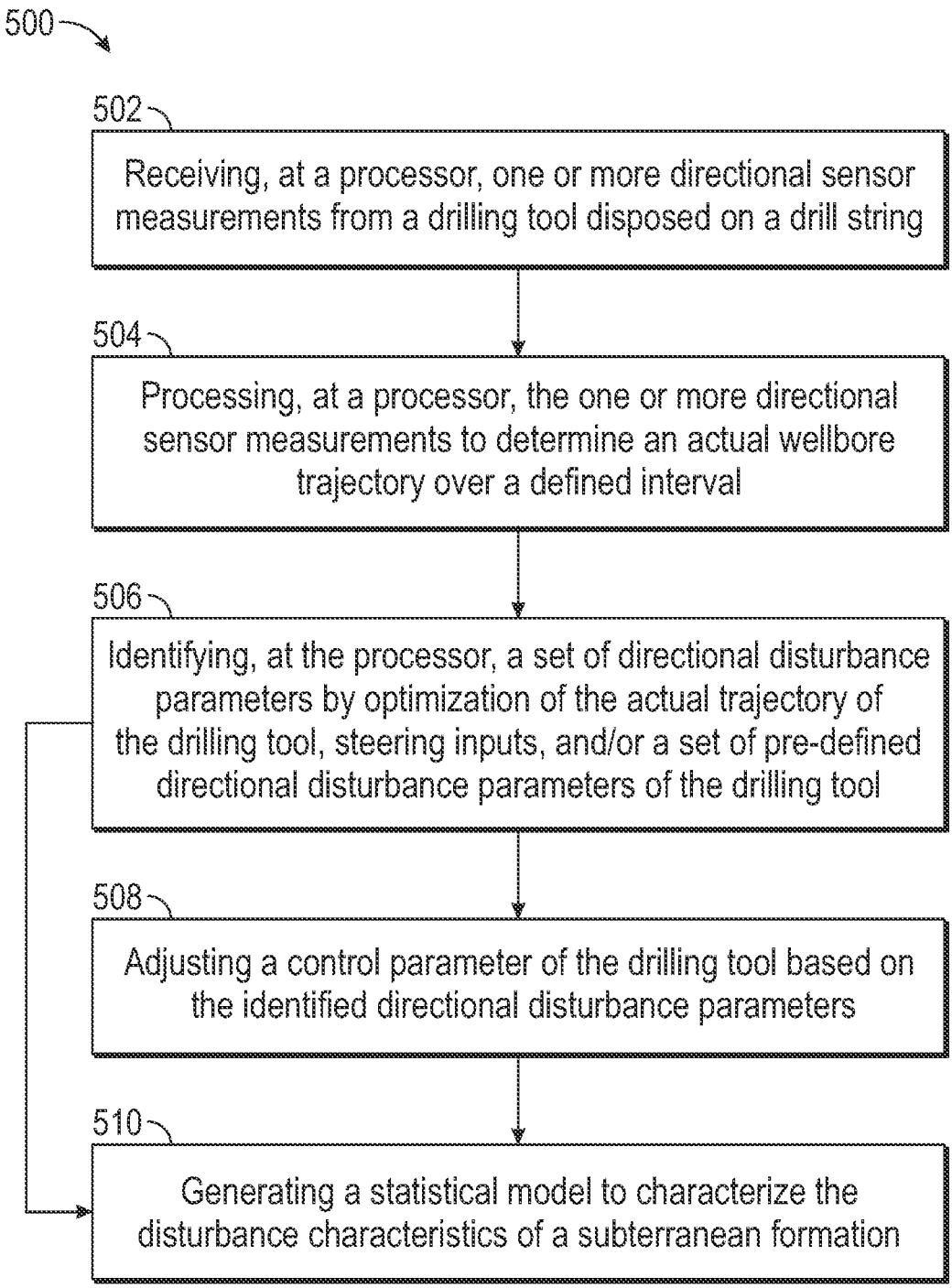
FIG. 5 is a flow chart of a drilling system with directional tendency estimation method according to the present disclosure.

Referring to FIG. 5, a flowchart is presented in accordance with an example method. The example method 500 is provided by way of example, as there is a variety of ways to carry out the method 500. Each block shown in FIG. 5 represents one or more processes, methods, or subroutines, carried out in the example method 500. Furthermore, the illustrated order of blocks is illustrative only and the order of the blocks can change according to the present disclosure. Additional blocks may be added or fewer blocks can be utilized, without deviating from the present disclosure. The example method 500 can begin at block 502.

At block 502, one or more directional sensor measurements can be received. The one or more directional sensor measurements can be received from stationary and/or continuous surveys. The one or more directional sensor measurements can include inclination and/or azimuth. The method 500 can proceed to block 504.

At block 504, the one or more directional sensor measurements can be processed to calculate a wellbore trajectory over a certain interval. The interval can be time and/or depth. The method 500 can proceed to block 506.

At block 506, a set of directional disturbance parameters are identified. The set of directional disturbance parameters can be determined by an optimization function of actual trajectory, steering inputs, and/or a set of pre-defined directional disturbance parameters. The method 500 can optionally proceed to block 508 or block 510.

At block 508, a downhole drilling tool can be adjusted based on the set of directional disturbance parameters. The set of directional disturbance parameters can be fed to a downhole steering control logic and/or used for controller setting adaption (for example, gain scheduling and direction offsetting). The method 500 can proceed to block 510.

At block 510, the identified directional disturbance parameters can be used to generate a statistical model to characterize the disturbance characteristics of the subterranean formation.

Figure 6:
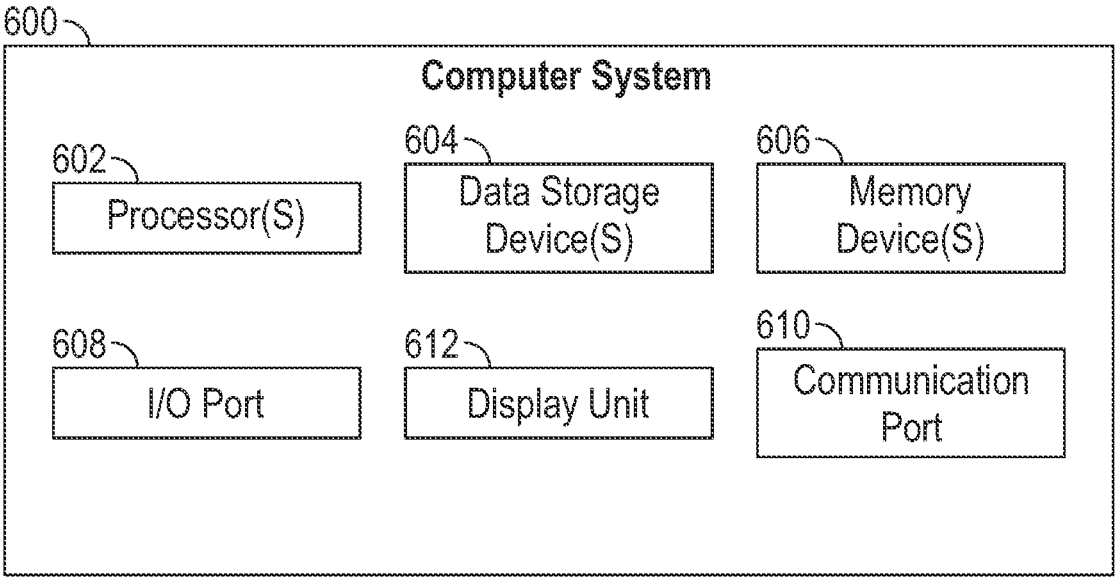
FIG. 6 is a diagram of a computer device that can implement various systems and methods discussed herein.

Referring to FIG. 6, a detailed description of an example computer device 600 that can operably implement various systems and methods discussed herein is provided. The computer device can be applicable to the drilling process 100 and/or one or more drilling tools 11, and other computing or network devices. It will be appreciated that specific implementations of these devices can be of differing possible specific computing architectures not all of which are specifically discussed herein but will be understood by those of ordinary skill in the art.

The computer device 600 can be a computing system capable of executing a computer program product to execute a computer process. Data and program files can be input to the computer device 600, which reads the files and executes the programs therein. Some of the elements of the computer device 600 are shown in FIG. 6, including one or more hardware processors 602, one or more data storage devices 604, one or more memory devices 608, and/or one or more ports 608-610. Additionally, other elements that will be recognized by those skilled in the art can be included in the computer device 600 but are not explicitly depicted in FIG. 6 or discussed further herein. Various elements of the computer device 600 can communicate with one another by way of one or more communication buses, point-to-point communication paths, or other communication means not explicitly depicted in FIG. 6.

The processor 602 can include, for example, a central processing unit (CPU), a microprocessor, a microcontroller, a digital signal processor (DSP), and/or one or more internal levels of cache. There can be one or more processors 602, such that the processor 602 comprises a single central-processing unit, or a plurality of processing units capable of executing instructions and performing operations in parallel with each other, commonly referred to as a parallel processing environment.

The computer device 600 can be a conventional computer, a distributed computer, or any other type of computer, such as one or more external computers made available via a cloud computing architecture. The presently described technology is optionally implemented in software stored on the data stored device(s) 604, stored on the memory device(s) 606, and/or communicated via one or more of the ports 608-610, thereby transforming the computer device 600 in FIG. 6 to a special purpose machine for implementing the operations described herein. Examples of the computer device 500 include personal computers, terminals, workstations, mobile phones, tablets, laptops, personal computers, multimedia consoles, gaming consoles, set top boxes, and the like.

The one or more data storage devices 504 can include any non-volatile data storage device capable of storing data generated or employed within the computer device 500, such as computer executable instructions for performing a computer process, which can include instructions of both application programs and an operating system (OS) that manages the various components of the computer device 600. The data storage devices 604 can include, without limitation, magnetic disk drives, optical disk drives, solid state drives (SSDs), flash drives, and the like. The data storage devices 604 can include removable data storage media, non-removable data storage media, and/or external storage devices made available via a wired or wireless network architecture with such computer program products, including one or more database management products, web server products, application server products, and/or other additional software components. Examples of removable data storage media include Compact Disc Read-Only Memory (CD-ROM), Digital Versatile Disc Read-Only Memory (DVD-ROM), magneto-optical disks, flash drives, and the like. Examples of non-removable data storage media include internal magnetic hard disks, SSDs, and the like. The one or more memory devices 606 can include volatile memory (e.g., dynamic random access memory (DRAM), static random access memory (SRAM), etc.) and/or non-volatile memory (e.g., read-only memory (ROM), flash memory, etc.).

Computer program products containing mechanisms to effectuate the systems and methods in accordance with the presently described technology can reside in the data storage devices 604 and/or the memory devices 606, which can be referred to as machine-readable media. It will be appreciated that machine-readable media can include any tangible non-transitory medium that is capable of storing or encoding instructions to perform any one or more of the operations of the present disclosure for execution by a machine or that is capable of storing or encoding data structures and/or modules utilized by or associated with such instructions. Machine-readable media can include a single medium or multiple media (e.g., a centralized or distributed database, and/or associated caches and servers) that store the one or more executable instructions or data structures.

In some implementations, the computer device 600 includes one or more ports, such as an input/output (I/O) port 608 and a communication port 610, for communicating with other computing, network, or vehicle devices. It will be appreciated that the ports 608-610 can be combined or separate and that more or fewer ports can be included in the computer device 600.

The I/O port 608 can be connected to an I/O device, or other device, by which information is input to or output from the computer device 600. Such I/O devices can include, without limitation, one or more input devices, output devices, and/or environment transducer devices.

In one implementation, the input devices convert a human-generated signal, such as, human voice, physical movement, physical touch or pressure, and/or the like, into electrical signals as input data into the computer device 600 via the I/O port 608. Similarly, the output devices can convert electrical signals received from computer device 600 via the I/O port 608 into signals that can be sensed as output by a human, such as sound, light, and/or touch. The input device can be an alphanumeric input device, including alphanumeric and other keys for communicating information and/or command selections to the processor 602 via the I/O port 1608. The input device can be another type of user input device including, but not limited to: direction and selection control devices, such as a mouse, a trackball, cursor direction keys, a joystick, and/or a wheel; one or more sensors, such as a camera, a microphone, a positional sensor, an orientation sensor, a gravitational sensor, an inertial sensor, and/or an accelerometer; and/or a touch-sensitive display screen ("touchscreen"). The output devices can include, without limitation, a display, a touchscreen, a speaker, a tactile and/or haptic output device, and/or the like. In some implementations, the input device and the output device can be the same device, for example, in the case of a touchscreen.

The environment transducer devices convert one form of energy or signal into another for input into or output from the computer device 600 via the I/O port 608. For example, an electrical signal generated within the computer device 600 can be converted to another type of signal, and/or vice-versa. In one implementation, the environment transducer devices sense characteristics or aspects of an environment local to or remote from the computer device 600, such as, light, sound, temperature, pressure, magnetic field, electric field, chemical properties, physical movement, orientation, acceleration, gravity, and/or the like. Further, the environment transducer devices can generate signals to impose some effect on the environment either local to or remote from the example computer device 600, such as, physical movement of some object (e.g., a mechanical actuator), heating or cooling of a substance, adding a chemical substance, and/or the like.

In one implementation, a communication port 610 is connected to a network by way of which the computer device 600 can receive network data useful in executing the methods and systems set out herein as well as transmitting information and network configuration changes determined thereby. Stated differently, the communication port 610 connects the computer device 600 to one or more communication interface devices configured to transmit and/or receive information between the computer device 600 and other devices by way of one or more wired or wireless communication networks or connections. Examples of such networks or connections include, without limitation, Universal Serial Bus (USB), Ethernet, Wi-Fi, Bluetooth®, Near Field Communication (NFC), Long-Term Evolution (LTE), and so on. One or more such communication interface devices can be utilized via the communication port 1310 to communicate one or more other machines, either directly over a point-to-point communication path, over a wide area network (WAN) (e.g., the Internet), over a local area network (LAN), over a cellular (e.g., third generation (3G) or fourth generation (4G)) network, or over another communication means. Further, the communication port 610 can communicate with an antenna or other link for electromagnetic signal transmission and/or reception.

In an example implementation, health data, air filtration data, and software and other modules and services can be embodied by instructions stored on the data storage devices 604 and/or the memory devices 606 and executed by the processor 602. The computer device 600 can be integrated with or otherwise form part of the system for dynamic light adjustments.

The system set forth in FIG. 6 is but one possible example of a computer system that can employ or be configured in accordance with aspects of the present disclosure. It will be appreciated that other non-transitory tangible computer-readable storage media storing computer-executable instructions for implementing the presently disclosed technology on a computing system can be utilized.

In the present disclosure, the methods disclosed can be implemented as sets of instructions or software readable by a device (e.g., the computer device 600). Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

STATEMENT BANK

Statement 1: A method comprising: receiving one or more directional sensor measurements from a drilling tool; determining, at a processor, an actual wellbore trajectory over a defined interval based on the one or more directional sensor measurements; and identifying, at the processor, optimized adjustments to a set of directional disturbance parameters based on a minimization of a cost function based on the actual trajectory of the drilling tool and a reference trajectory.

Statement 2: The method of Statement 1, wherein the reference trajectory is based on a model of borehole propagation.

Statement 3: The method of Statement 1 or Statement 2, wherein the one or more directional sensor measurements include inclination and/or azimuth.

Statement 4: The method of any one of Statements 1-3, wherein the pre-defined set of directional disturbance parameters are tool face direction and/or curve generation capability.

Statement 5: The method of any one of Statements 1-4, further comprising adjusting a control parameter of the drilling tool based on the identified directional disturbance parameters.

Statement 6: The method of any one of Statements 1-5, wherein the processor determines the actual wellbore trajectory and identifies optimized adjustments in real-time.

Statement 7: The method of any one of Statements 1-6, wherein the processor determines the actual wellbore trajectory and identifies optimized adjustment directional data from one or more adjacent wells.

Statement 8: The method of any one of Statements 1-7, wherein the at least one drilling parameter is one of weight on bit, rotation per minute, rate of penetration, torque on bit, inclination, and flow rate.

Statement 9: The method of any one of Statements 1-8, wherein the one or more directional sensor measurements are taken continuously.

Statement 10: The method of any one of Statements 1-9, wherein the one or more directional sensor measurements are stationary.

Statement 11: The method of any one of Statements 1-10, wherein the processor determines the actual wellbore trajectory and identifies optimized adjustments after the well has been drilled Statement 12: The method of any one of Statements 1-11, further comprising generating a statistical model to characterize the disturbance characteristics of a subterranean formation.

Statement 13: The method of any one of Statements 1-12, wherein the statistical model is operable to calibrate a drilling tool during wellbore formation.

Statement 14: The method of any one of Statements 1-13, further comprising generating a statistical model to characterize the disturbance characteristics of a subterranean formation.

Statement 15: The method of any one of Statements 1-14, wherein the statistical model is operable to calibrate a drilling tool during wellbore formation.

Statement 16: The method of any one of Statements 1-15, wherein identifying the set of directional disturbance parameters is further based on steering inputs, and/or a set of pre-defined directional disturbance parameters of the drilling tool.

Statement 17: The method of any one of Statements 1-16, further comprising generating a stochastic model to characterize the directional steering probabilities in a subterranean formation.

Statement 18: The method of any one of Statements 1-17, wherein identifying the set of directional disturbance parameters is further based on at least one drilling parameter.

Statement 19: The method of any one of Statements 1-18, wherein identifying the set of directional disturbance parameters is further based on BHA design.

Statement 20: The method of any one of Statements 1-19, wherein BHA design includes at least one of bit selection and type, stabilizer placements, and drilling fluid properties.

Statement 21: The method of any one of Statements 1-20, wherein identifying the set of directional disturbance parameters is further based on rock being at least one of rock strength, rock type, anisotropy, and confinement stresses.

Statement 22: The method of any one of Statements 1-21, wherein identifying the set of directional disturbance parameters is transferred and built upon across a plurality wells and that resulting model is used to improve prediction/recommendation in subsequent well.

Statement 23. A system comprising: a drilling rig operable to form a wellbore in a subterranean formation, the drilling rig having one or more processors and a memory coupled therewith, the one or more processors operable to execute instructions stored in the memory that causes the drilling system to: receive one or more directional sensor measurements from a drilling tool; determine an actual wellbore trajectory over a defined interval based on the one or more directional sensor measurements; and identify optimized adjustments to a set of directional disturbance parameters based on a minimization of a cost function based on the actual trajectory of the drilling tool and a reference trajectory.

Statement 24: The system of Statement 23, wherein the reference trajectory is based on a model of borehole propagation.

Statement 25: The system of Statement 23 or Statement 24, wherein the one or more directional sensor measurements include inclination and/or azimuth.

Statement 26: The system of any one of Statements 23-25, wherein the pre-defined set of directional disturbance parameters are tool face direction and/or curve generation capability.

Statement 27: The system of any one of Statements 23-26, further comprising adjusting a control parameter of the drilling tool based on the identified directional disturbance parameters.

Statement 28: The system of any one of Statements 23-27, wherein the processor determines the actual wellbore trajectory and identifies optimized adjustments in real-time.

Statement 29: The system of any one of Statements 23-28, wherein the processor determines the actual wellbore trajectory and identifies optimized adjustment directional data from one or more adjacent wells.

Statement 30: The system of any one of Statements 23-29, wherein the at least one drilling parameter is one of weight on bit, rotation per minute, rate of penetration, torque on bit, inclination, and flow rate.

Statement 31: A non-transitory computer-readable medium comprising executable instructions, which when executed by a processor, causes the processor to: receive one or more directional sensor measurements from a drilling tool; determine an actual wellbore trajectory over a defined interval based on the one or more directional sensor measurements; and identify optimized adjustments to a set of directional disturbance parameters based on a minimization of a cost function based on the actual trajectory of the drilling tool and a reference trajectory.

Statement 32: The non-transitory computer-readable medium of Statement 31, wherein the reference trajectory is based on a model of borehole propagation.

Statement 33: The non-transitory computer-readable medium of Statement 31 or Statement 32, wherein the one or more directional sensor measurements include inclination and/or azimuth.

Statement 34: The non-transitory computer-readable medium of any one of Statements 31-33, wherein the processor determines the actual wellbore trajectory and identifies optimized adjustments in real-time.

What is claimed is:

1. A method comprising:

receiving one or more directional sensor measurements from a drilling tool;

determining, at a processor, an actual wellbore trajectory over a defined interval based on the one or more directional sensor measurements;

identifying, at the processor, optimized adjustments to a set of directional disturbance parameters based on a minimization of a cost function for a trajectory model, wherein the minimization of the cost function is determined based on the actual trajectory of the drilling tool and the trajectory model characterizes disturbances associated with the directional disturbance parameters as a function of either or both depth and formation characteristics based on a steering input vector and the directional disturbance parameters; and controlling drilling performance of the drilling tool by steering the drilling tool based on one or more of the set of directional disturbance parameters.

2. The method of claim 1, wherein the reference trajectory is based on a model of borehole propagation.

3. The method of claim 1, wherein the one or more directional sensor measurements include inclination and/or azimuth.

4. The method of claim 1, wherein the pre-defined set of directional disturbance parameters are tool face direction and/or curve generation capability.

5. The method of claim 1, further comprising adjusting a control parameter of the drilling tool based on the identified directional disturbance parameters.

6. The method of claim 1, wherein the processor determines the actual wellbore trajectory and identifies optimized adjustments in real-time.

7. The method of claim 1, wherein the processor determines the actual wellbore trajectory and identifies optimized adjustment directional data from one or more adjacent wells.

8. The method of claim 1, wherein the at least one drilling parameter is one of weight on bit, rotation per minute, rate of penetration, torque on bit, inclination, and flow rate.

9. A system comprising:

a drilling rig operable to form a wellbore in a subterranean formation, the drilling rig having one or more processors and a memory coupled therewith, the one or more processors operable to execute instructions stored in the memory that causes the drilling system to:

receive one or more directional sensor measurements from a drilling tool;

determine an actual wellbore trajectory over a defined interval based on the one or more directional sensor measurements;

identify optimized adjustments to a set of directional disturbance parameters based on a minimization of a cost function for a trajectory model, wherein the minimization of the cost function is determined based on the actual trajectory of the drilling tool and the trajectory model characterizes disturbances associated with the directional disturbance parameters as a function of either or both depth and characteristics of the formation based on a steering input vector and the directional disturbance parameters; and control drilling performance of the drilling tool by steering the drilling tool based on one or more of the set of directional disturbance parameters.

10. The system of claim 9, wherein the reference trajectory is based on a model of borehole propagation.

11. The system of claim 9, wherein the one or more directional sensor measurements include inclination and/or azimuth.

12. The system of claim 9, wherein the pre-defined set of directional disturbance parameters are tool face direction and/or curve generation capability.

13. The system of claim 9, further comprising adjusting a control parameter of the drilling tool based on the identified directional disturbance parameters.

14. The system of claim 9, wherein the processor determines the actual wellbore trajectory and identifies optimized adjustments in real-time.

15. The system of claim 9, wherein the processor determines the actual wellbore trajectory and identifies optimized adjustment directional data from one or more adjacent wells.

16. The system of claim 9, wherein the at least one drilling parameter is one of weight on bit, rotation per minute, rate of penetration, torque on bit, inclination, and flow rate.

17. A non-transitory computer-readable medium comprising executable instructions, which when executed by a processor, causes the processor to:

receive one or more directional sensor measurements from a drilling tool;

determine an actual wellbore trajectory over a defined interval based on the one or more directional sensor measurements;

identify optimized adjustments to a set of directional disturbance parameters based on a minimization of a cost function for a trajectory model, wherein the minimization of the cost function is determined based on the actual trajectory of the drilling tool and the trajectory model characterizes disturbances associated with the directional disturbance parameters as a function of either or both depth and formation characteristics based on a steering input vector and the directional disturbance parameters; and controlling drilling performance of the drilling tool by steering the drilling tool based on one or more of the set of directional disturbance parameters.

18. The non-transitory computer-readable medium of claim 17, wherein the reference trajectory is based on a model of borehole propagation.

19. The non-transitory computer-readable medium of claim 17, wherein the one or more directional sensor measurements include inclination and/or azimuth.

20. The non-transitory computer-readable medium of claim 17, wherein the processor determines the actual wellbore trajectory and identifies optimized adjustments in real-time.

* * * * *